United States Patent [19]

Dresen et al.

[11] Patent Number: 4,830,066

[45] Date of Patent: May 16, 1989

[54] DEVICE FOR FILLING AND EMPTYING PRESSURE CYLINDERS LOCATED ON PALLETS

[75] Inventors: Heinz D. Dresen, Duisburg; Siegbert Schmidt, Moers, both of Fed. Rep. of Germany

[73] Assignee: Messer Griesheim GmbH, Fed. Rep. of Germany

[21] Appl. No.: 147,565

[22] Filed: Jan. 19, 1988

Related U.S. Application Data

[63] Continuation of Ser. No. 906,305, Sep. 12, 1986, abandoned.

[30] Foreign Application Priority Data

Sep. 24, 1985 [DE] Fed. Rep. of Germany ..... 8527163

[51] Int. Cl.[4] ..... B65B 3/04

[52] U.S. Cl. ..... 141/1; 141/236; 141/244

[58] Field of Search ..... 141/1-5, 141/83, 197, 231, 236, 237, 242, 244, 245, 382, 387

[56] References Cited

U.S. PATENT DOCUMENTS

| | | | |
|---|---|---|---|
| 3,566,930 | 2/1971 | Kirschner | 141/244 |
| 4,542,774 | 9/1985 | Stavlo | 141/1 |

FOREIGN PATENT DOCUMENTS

| | | | |
|---|---|---|---|
| 1376036 | 9/1964 | France | 141/244 |
| 121639 | 9/1926 | Switzerland | 141/244 |
| 2066935 | 7/1981 | United Kingdom | 141/83 |

*Primary Examiner*—Ernest G. Cusick

*Attorney, Agent, or Firm*—Connolly & Hutz

[57] ABSTRACT

A device for filling and emptying pressure gas cylinders includes a manifold attached to the pallet via a shut-off valve. The fill and emptying stations are provided with nipples connected by a hose to one of the pressure gas cylinders.

6 Claims, 2 Drawing Sheets

DEVICE FOR FILLING AND EMPTYING PRESSURE CYLINDERS LOCATED ON PALLETS

CROSS REFERENCE TO RELATED APPLICATION

This application is a continuation of Application Serial No. 906,305, filed Sept. 12, 1986, now abandoned.

BACKGROUND OF INVENTION

The invention is concerned with a device for filling and emptying pressure cylinders located on pallets.

Pressure cylinders located on pallets are filled and emptied individually. To empty them, the pressure cylinders are removed from the pallet and set up at the various consumption locations of the user. Empty pressure cylinders are replaced by some from the pallet that are still filled.

When using greater gas quantities at a location of the installation, one uses clusters of cylinders. In such cylinder clusters, a greater number of pressure cylinders is firmly joined together and so connected together by pipes that all pressure cylinders can be simultaneously emptied and, likewise, simultaneously filled.

There are users who, in their business, as a rule, use only single pressure cylinders which are made available, in the usual manner, on pallets. With such users, there occurs more or less often, a greater demand which is not adequately met by drawing from a single cylinder.

It does not pay, in such cases, to make available the better suited cylinder clusters.

SUMMARY OF INVENTION

The objective of the invention is to provide a device which makes it possible, in the event that there is a demand, to simultaneously fill and empty pressure cylinders located on pallets as with cylinder clusters.

Pressure gas cylinders are filled and emptied by a manifold attached to the pallet via a shut-off valve. The fill and emptying stations are provided with nipples connected by a hose to one of the pressure gas cylinders.

The invention makes it possible, in the event that there is a demand, to simultaneously empty a greater number of the pressure cylinders located on a pallet since a simple device is attached to the pallet and a connection to the individual cylinders is established by means of flexible hoses. At the gas filler, the invention provides the advantage that the cylinders of a pallet can be filled simultaneously, whereby a considerably time saving results.

DETAILED DESCRIPTION OF THE PREFERRED EMBODIMENT

Figure 1:
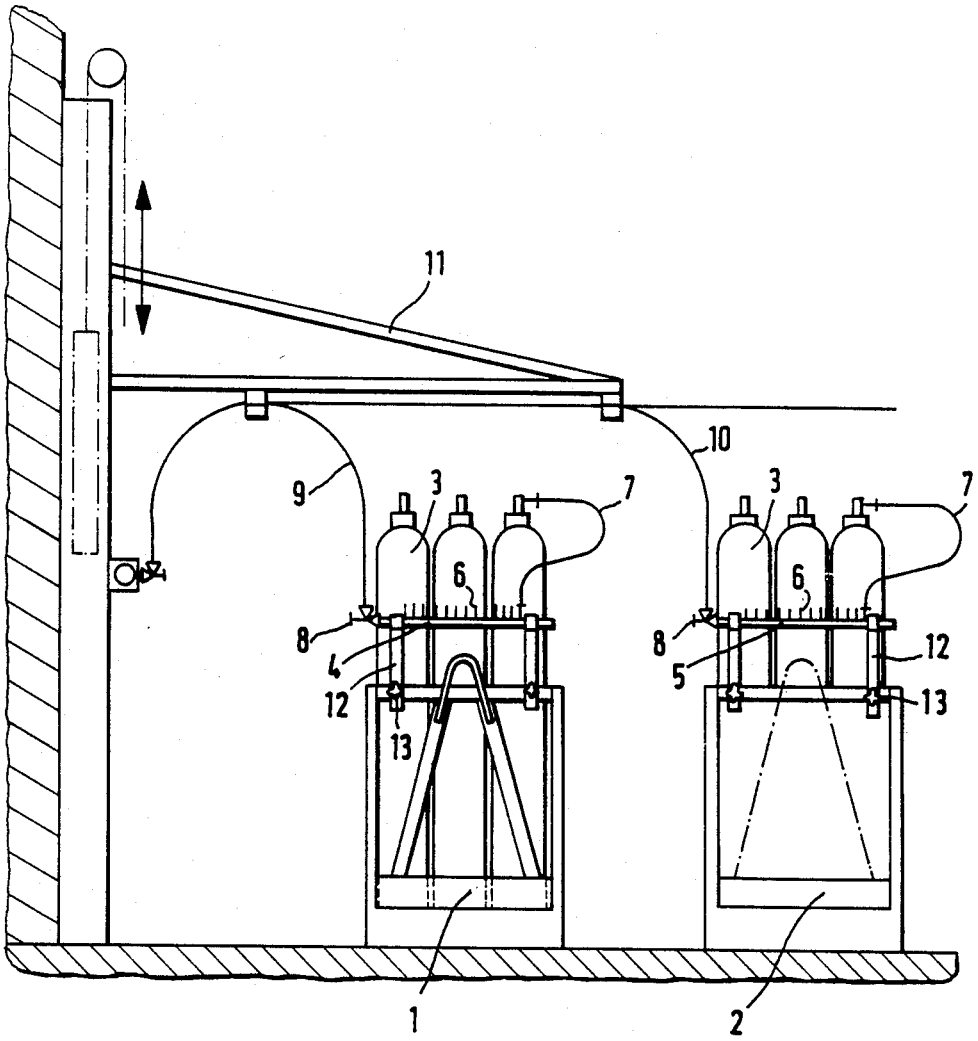
FIG. 1 shows a filling station, equipped with the device according to the invention, for simultaneously filling the pressure cylinders on two pallets.

FIG. 1 shows two pallets 1, 2 with twelve pressure cylinders each of which are filled or emptied simultaneously. According to the invention, the two distribution pipes or manifolds 4, 5 which have twelve connector nipples 6 each. Each connector nipple 6 is connected, by means of a hose 7, to a pressure cylinder 3 on the appropriate pallet 1 or 2. For the purpose of overviewing, only one such hose connection is illustrated.

The manifolds 4, 5 have shut off valves 8 to which the hoses 9, 10 are connected. The hoses 9, 10 (which may be either filling or drain hoses) hang on a bracket 11 which is adjustable by means of a counterweight so that even pallets of different sizes can be filled or emptied. The manifolds 4, 5 are welded onto the supports 12 which in turn can be firmly attached to the pallets 1, 2 by menas of screw clamps 13.

Thus, the filling location would be provided with a hose, distribution pipe and tubes for filling the cylinders. Similarly, the emptying location would be provided with a further hose, a further distribution pipe, and further tubes for emptying the cylinders.

Figure 2:
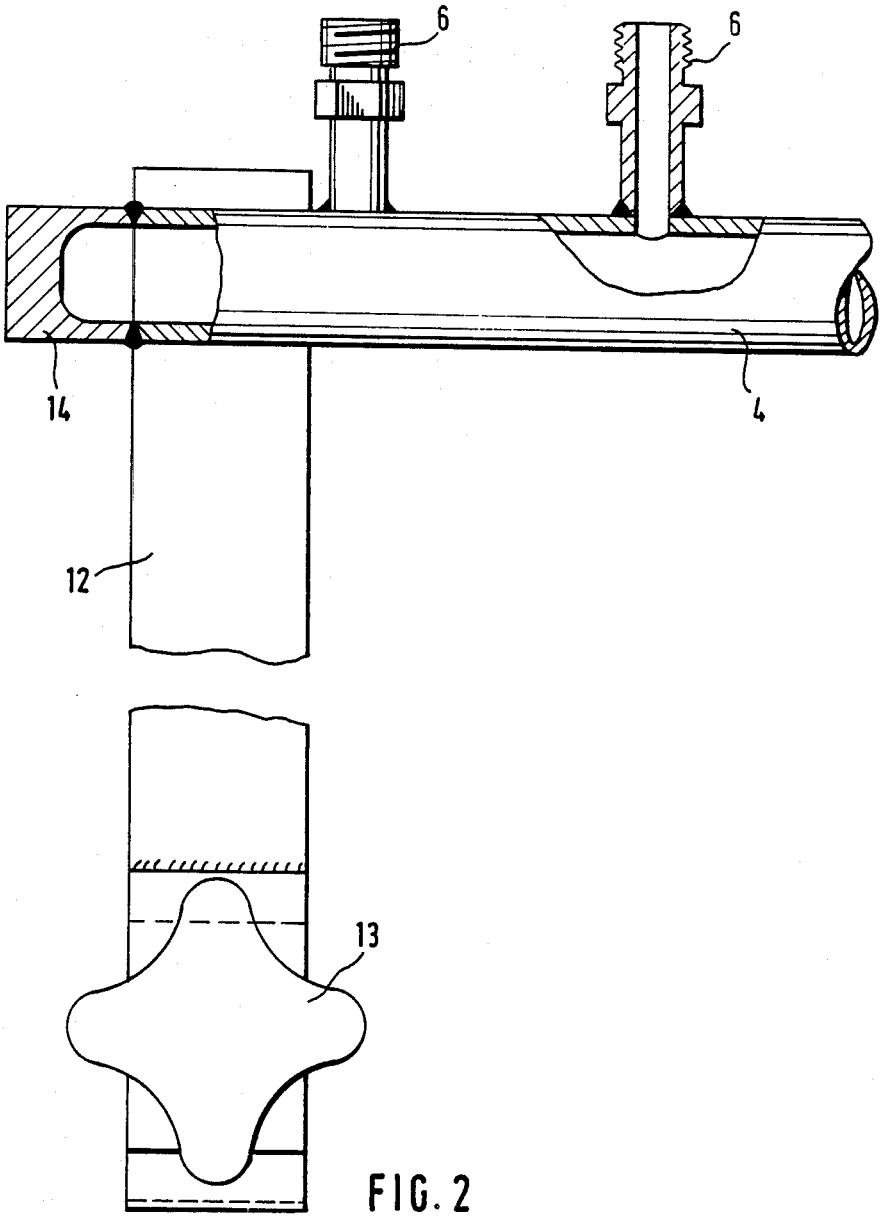
FIG. 2 is a partial section of the end piece of a distribution manifold.

FIG. 2 shows a partial section of a manifold 4 with connecting nipples 6. The depicted end of the manifold 4 is sealed with a welded on cap 14. At the end of the manifold 4 which is not shown, there is a shut off valve 8 instead of the cap. The manifold 4 purposely has as many connection nipples as there are pressurized gas containers 3 on the pallet. However, some connection nipples can be screwed shut when, for example, not all the pressurized gas containers are emptied at the same time or when a manifold which is designed for a larger pallet is connected to a smaller pallet with less pressurized gas containers.

The manifold 4 is welded onto the supports 12 which consist of sheet steel. The end of the support 12 is forked so that the entire device can be set up onto a pallet and clamped tightly by the screw clamps 13. Naturally, other fastening mechanisms are also possible.

What is claimed is:

1. A method for supplying gas cylinders from a location of filling the gas cylinders to a location of usage, comprising individually removably mounting a number of the cylinders on a pallet, detachably mounting a gas distribution pipe on the pallet, detachably mounting supply tubes to the distribution pipe, providing communication between the cylinders and the gas distribution pipe through the supply tubes and communication between a supply hose and the gas distribution pipe through a shut-off valve, simultaneously filling the cylinders by feeding the gas through the supply hose and through the gas distribution pipe and through the supply tubes into the cylinders, manipulating the shut-off valve to close communication between the supply hose and the distribution pipe after the cylinders are filled, disconnecting the supply hose and the distribution pipe and the shut-off valve and the supply tubes from the pallet, moving the pallet to the locatoin of intended use, discharging the gas from at least one of the cylinders.

2. In the method of claim 1 including detachably mounting a further hose and a further distribution pipe and further tubes to the pallet, connecting each of the tubes to a cylinder, and simultaneously discharging gas from the cylinders through the tubes and distribution pipe and hose.

3. In the method of claim 1 including discharging the gas directly from a single cylinder.

4. In a device for selectively filling and emptying gas cylinders wherein a plurality of the cylinders are individually removably mounted on a pallet whereby a cylinder may be removed from the pallet and set up at its location of intended use, the improvement comprising a distribution pipe detachably mounted on said pallet, a plurality of connection nipples on said pipe communication with the interior of said pipe, a plurality of tubes each of which is adapted to be detachably connected to one of said cylinders and a respective nipple to provide communication between said pipe and said cylinders, a hose connected to said pipe to selectively function as a conduit for the supply of gas to said cylinders for filling said cylinders and for the extraction of gas from said cylinders at the site of use, and said pipe having a shut-off valve for selectively preventing flow of gas into and out of said pipe.

5. Device according to claim 4 including a bracket mounted above said pallet, a flexible fill hose suspended from said bracket and communicating with said pipe and each of said tubes being a flexible hose.

6. Device according to claim 4, characterized therein that the number of connection nipples equals the number of gas cylinders on the pallet.

* * * * *